US006035499A

United States Patent [19]

Ninomiya

[11] Patent Number: 6,035,499

[45] Date of Patent: Mar. 14, 2000

[54] CONNECTING DEVICE FOR JEWELRY AND ACCESSORY

[75] Inventor: Tomoyasu Ninomiya, Tokyo, Japan

[73] Assignee: Seberu Pico Corporation, Tokyo, Japan

[21] Appl. No.: 08/956,054

[22] Filed: Oct. 22, 1997

[30] Foreign Application Priority Data

Oct. 30, 1996 [JP] Japan ..... 8-304080

[51] Int. Cl.[7] ..... A44B 17/00

[52] U.S. Cl. ..... 24/615; 24/71 J; 24/116 A; 24/616

[58] Field of Search ..... 24/616, 615, 617, 24/71 J, 116 A, 265 WS

[56] References Cited

U.S. PATENT DOCUMENTS

| | | | |
|---|---|---|---|
| 2,986,792 | 6/1961 | Wyatt | 24/616 |
| 3,967,351 | 7/1976 | Rosenberg et al. | 24/616 |
| 4,024,607 | 5/1977 | Rosenberg et al. | 24/616 |
| 4,520,537 | 6/1985 | Valikov | 24/116 A |
| 4,745,667 | 5/1988 | Conte | 24/615 |

*Primary Examiner*—Victor N. Sakran

*Attorney, Agent, or Firm*—Wenderoth, Lind & Ponack, L.L.P.

[57] ABSTRACT

A connecting device for jewelry and accessory comprising a spring member made in manner that a metallic plate with an elasticity is bent to form a plate spring comprising a first plate spring section and a second plate spring section and a connecting device body including a base plate and a spring casing section placed on the base plate. The first plate spring section has one end equipped with a locking portion and a pushing handle, while the second plate spring section has one end equipped with a spring body side wall section rising to surround the pushing handle, the spring body side wall section having curved edges curved to lower so that both side surface portions thereof continuing with its central portion has one of an arc configuration and a tapered configuration. On the other hand, the spring casing section of the connecting device body has a hollow portion to accept the spring member and has one side wall curved to lower to form an arc or tapered configuration. The curved side wall has an entry to insert the spring member. In the entry, an engaging portion is provided to engage with the locking portion of the spring member due to the elasticity of the plate spring when the spring member is inserted into the spring casing section.

8 Claims, 5 Drawing Sheets

CONNECTING DEVICE FOR JEWELRY AND ACCESSORY

BACKGROUND OF THE INVENTION

1. Field of the Invention

The present invention relates to a connecting device for jewelry and accessory such as necklaces, bracelets and straps.

2. Description of the Prior Art

In a prior representative connecting device for jewelry and accessory, as shown in FIG. 10, a metallic plate having an elasticity is bent to make a given angle to thereby form a plate spring 1 comprising a first plate spring section 2 and a second plate spring section 5, which constitute a spring member 8. The first plate spring section 2 has locking portions 3, 3 and a pushing handle 4 at its end portion while the second plate spring section 5 has a connecting portion 7 which makes connection with one end of jewelry and accessory such as a necklace 6. Further, a connecting device body 13 being a mate has a hollow component 9 which in turn, has an entry 10 in its one side wall surface, with this entry 10 accepting the spring member 8. Formed in the entry 10 are locking portions 11, 11 which engage with the locking portions 3, 3 of the spring member due to the elasticity of the first plate spring section 2 when the spring member 8 is inserted into the hollow component 9. Moreover, the hollow component 9 has, at its other side wall surface, a connecting portion 12 which is connected to the other end of the necklace 6.

For use of this jewelry and accessory connecting device, as shown in FIG. 11, the spring member 8 is inserted into the entry 10 from its turning portion 14 side to advance within the hollow component 9, and at this time the first plate spring section 2 is pressed by the edges of the locking portions 11, 11. At the time that the locking portions 3, 3 pass through the locking portions 11, 11, the first plate spring section 2 is released from the depression by the locking portions 11, 11, and the locking portions 3, 3 receive the elasticity of the first plate spring section 2 to engage with the inner surfaces of the locking portions 11, 11, so that the spring member 8 is locked so as not to be free from the hollow component 9. On the other hand, when disconnecting the spring member 8 from the connecting device body 13, the pushing handle 4 is pressed by a finger to press the first plate spring section 2, and simultaneously the locking portions 3, 3 are detached from the locking portions 11, 11 and the spring member 8 is pulled out from the entry 10.

However, in the case of the prior jewelry and accessory connecting device, the spring member 8 tends to be inserted thereinto in a state of being upside down, that is, the spring member 8 can be inserted through the entry 10 into the hollow component 9 in a state where the first plate spring section 2 and the pushing handle 4 are at the opposite side to the positions shown in FIG. 10. In this case, the spring member 8 is disconnected from the hollow component 9 so that the necklace 6 falls off. For this reason, when the spring member 8 is inserted into the hollow component 9, the user must pay attention to the state of the spring member 8. This is troublesome. Further, even in the case that the spring member 8 is normally inserted into the hollow component 9, the projection of the pushing handle 4 can injure the user or the hair can be hooked by the pushing handle 4. Moreover, the projection of the pushing handle 4 has unattractive appearance.

SUMMARY OF THE INVENTION

It is therefore an object of the present invention to provide a connecting device for jewelry and accessory which is capable of eliminating the above-mentioned problems.

For this purpose, in accordance with the present invention, a connecting device for jewelry and accessory comprises a spring member made in manner that a metallic plate with an elasticity is bent to form a plate spring comprising a first plate spring section and a second plate spring section which made a given angle therebetween and a connecting device body including a base plate and a spring casing section placed on a rear surface of the base plate. The first plate spring section of the spring member has one end equipped with a locking portion and a pushing handle, while the second plate spring section thereof has one end equipped with a spring body side wall section rising to surround the pushing handle, and the spring body side wall section has curved edges curved to lower so that both side surface portions thereof continuing with its central portion have an arc or tapered configuration. The spring body side wall section being provided with a connecting portion of one end portion of the jewelry and accessory. On the other hand, the spring casing section of the connecting device body has a hollow portion to accept the spring member and has one side wall curved to lower to form an arc or tapered configuration or lower at right angles, and the curved side wall has an entry to insert the spring member. In this entry, an engaging portion is provided to engage with the locking portion of the spring member due to the elasticity of the plate spring when the spring member is inserted into the spring casing section. The other side wall of the spring casing section is equipped with a connecting portion of the other end portion of the jewelry and accessory.

Furthermore, in accordance with this invention, a connecting device for jewelry and accessory comprises a pair of spring members each made in manner that a metallic plate with an elasticity is bent to form a plate spring comprising a first plate spring section and a second plate spring section which made a given angle therebetween and a connecting device body including a base plate and a spring casing section placed on a rear surface of said base plate. The first plate spring section has one end equipped with a locking portion and a pushing handle, while the second plate spring section has one end equipped with a spring body side wall section rising to surround the pushing handle, and the spring body side wall section has curved edges curved to lower so that both side surface portions thereof continuing with its central portion have an arc or tapered configuration. On the other hand, the spring casing section of the connecting device body has a hollow portion to accept the pair of spring members in an opposed relation and has both side walls each curved to lower to form an arc or tapered configuration or to lower at right angles. Each of the curved side walls has an entry to insert the spring member. In this entry, an engaging portion is provided to engage with the locking portion of the spring member due to the elasticity of the plate spring when the spring member is inserted into the spring casing section.

Preferably, the spring member further includes a second base plate placed on a surface of said second plate spring section, with said surface being opposite to the surface on which the spring body side wall section is located. The second base plate integrally constitutes decorations in cooperation with the base plate of the connecting device body when the spring member is inserted into the spring casing section.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
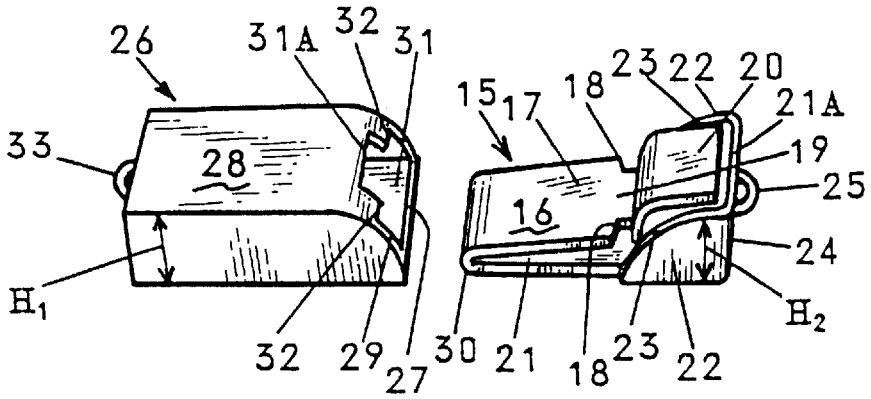
FIG. 1 is a perspective view showing a connecting device for jewelry and accessory according to a first embodiment of the present invention, where a spring member is removed from a connecting device body.

A connecting device for jewelry and accessory is composed of a spring member and a connecting device body, with, for example, the spring member being made by press formation and the connecting device body being formed by forging.

The spring member is made by bending a metallic plate with an elasticity to form a plate spring comprising a first plate spring section and a second plate spring section which make a given angle therebetween. The first spring plate has a locking portion and pushing handle at its end portion while the second plate spring section rises at its end portion to surround the pushing handle and both side portions of the rising section downwardly extending from its central portion are shaped into an arc or tapered configuration, thereby creating a spring body side wall section with curved edges. This spring body side wall section is equipped with a connecting portion for connection to one end of jewelry and accessory.

The connecting device body has a spring casing section on the rear surface of a base plate, with the spring casing section having a hollow portion which can accept the aforesaid spring member. One side wall of the spring casing section is curved to be formed into an arc or tapered configuration or to fall at right angles. This curved side wall has an entry for the spring member, and a locking portion is formed in the entry to engage with the locking portion of the spring member due to the elasticity of the plate spring when the spring member is inserted into the spring casing section. Further, the other side wall of the spring member is provided with a connecting portion for connection to the other end of jewelry and accessory. Incidentally, in addition to use a common flat plate for the base plate, it is also possible to employ a plate having appropriate decorations on its surface.

The aforesaid connecting device body can also be manufactured as follows. That is, a spring casing section with a hollow portion into which a pair of spring members are inserted in opposed relation is placed on the rear surface of a base plate, and both side walls of this spring casing section are curved to be formed into an arc or tapered configuration or to fall at right angles, and each of the curved side walls has an entry for the pair of spring members, and in each of the entries, a locking portion is provided to engage with a locking portion of each of the spring members due to the elasticity of the plate spring when each of the spring members is inserted into the spring casing section.

Furthermore, the spring member can also be produced as follows. That is, in an end of the other plate spring section of the spring member, on the surface on which the spring body side wall portion is located and the opposite surface, base plates are provided to make connection with the base plate of the connecting device body to integrally form decorations when the spring member is inserted into the spring casing section of the connecting device body.

In the jewelry and accessory connecting device thus arranged, in a state where the spring member is inserted into the spring casing section to make the locking portion of the spring member engage with the locking portion formed in the entry of the spring casing section, when the spring member is detached from the connecting device body, the connecting device body is held by one hand while the tip portion of the thumb of the other hand is moved to slide along the arc or tapered curved edges extending from the central portion of the spring body side wall section to both the side surface portions to press the pushing handle. At this time, the locking portion of the spring member is released from the locking portion of the spring casing section and the spring member is pulled out of the spring casing section. Or, the connecting device body is held by one hand and the tip portion of the thumb of the same hand is moved to slide along the arc or tapered curved side wall of the spring casing section (in the case that the side wall is bent at right angles, the operation depends upon both the hands) to press the pushing handle so that the locking portion of the spring member is released from the locking portion of the spring casing section and the spring member is pushed out of the spring casing section using the tip portion of the thumb.

Embodiments of the present invention will be described hereinbelow with reference to FIGS. 1 to 8. In FIG. 1, numeral 15 represents a spring member made in a manner that a metallic plate with an elasticity is bent to make a given angle to form a plate spring 16 comprising a first plate spring section 17 and a second plate spring section 21. The first plate spring section 17 is, at its one end portion, equipped with locking portions 18, 18 made in both side portions thereof and a pushing handle 20 rising stepwise from the tip portion of a connecting plate 19 narrowed by the locking portions 18, 18 and having a rectangular configuration. The second plate spring section 21 is, at its one end portion, provided with a spring body side wall section 24 rising to rectangularly surround the pushing handle 20 and including both side surface portions 22, 22 connecting with a central portion 21A of the rising section. The both side surface portions 22, 22 respectively have curved edges 23, 23 curved to lower to define arc or tapered configurations. The spring body side wall 24 is equipped with a connecting portion 25 being one ring for connection to one end of jewelry and accessory.

Furthermore, numeral 26 designates a connecting device body in which a rectangular spring casing section 28 with a hollow portion which can accept the spring member 15 is provided on the rear surface of a rectangular base plate 27. One side wall 29 of the spring casing section 28 is curved to form an arc or tapered configuration or curved to substantially fall at right angles. This curved side wall 29 has an entry 31 into which the spring member 15 is inserted from its turning portion 30. In this entry 31, an engaging opening 31A is made to engage with the connecting plate 19 of the spring member 15 due to the elasticity of the plate spring 17 when the spring member 15 is inserted into the spring casing section 28 and further engaging portions 32, 32 are provided in both sides of the engaging opening 31A to engage with the locking portions 18, 18 of the spring member 15 due to the elasticity of the plate spring 17. Moreover, in the spring casing section 28, a rectangular side wall opposite to the side wall 29 is equipped with a connecting portion 33 being one ring for connection to the other end portion of the aforesaid jewelry and accessory.

In this embodiment, in the case of locking the spring member 15 with the connecting device body 26, the spring member 15 is inserted into the entry 31 from its turning portion and subsequently advanced into the spring casing section 28, and at this time the plate spring 17 is pressed by the engaging portions 32, 32, and when the locking portions 18, 18 of the spring member 15 pass through the engaging portions 32, 32, the plate spring 17 is released from the pressing by the engaging portions 32, 32, so that the connecting plate 19 receives the elasticity of the plate spring 17 to engage with the engaging opening 31A and, at the same time, the locking portions 18, 18 also engage with the inner surfaces of the engaging portions 32, 32 due to the elasticity of the plate spring 17, with the result that the spring member 15 is hooked by the spring casing section 28 so as not to come out.

In this state, in the case of disconnecting the spring member 15 from the connecting device body 26, the connecting device body 26 is held by one hand while the tip portion of the thumb of the other hand is moved to slide along the curved edges 23, 23 of the spring body side wall section 24 of the spring member 15 to press the pushing handle 20 to disconnect the connecting plate 19 from the engaging opening 31A. Simultaneously with this, the locking portions 18, 18 are detached from the engaging portions 32, 32 and the spring member 15 is pulled out of the spring casing section 28. Or, the connecting device body 26 is held by one hand and the thumb of the same hand is moved to slide along the curved side wall 29 having the arc or tapered configuration of the spring casing section 28 (in the case that the side wall 29 is curved at right angles, the operation depends upon both hands) to press the pushing handle 20 so that the connecting plate 19 is disconnected from the engaging opening 31A and, at the same time, the locking portions 18, 18 are detached from the engaging portions 32, 32 and the spring member 15 is pushed out of the spring casing section 28 by the tip portion of the aforesaid thumb. Since the height $H_1$ of the connecting device body 26 is designed to be equal or substantially equal to the height $H_2$ of the spring body side section 24 of the spring member 15, in the state that the spring member 15 is inserted into the spring casing section 28, the connecting device body 26, the pushing handle 20 of the spring member 15 and the spring body side wall section 24 constitute an appearance that a rectangular box is divided into two sections which in turn, are joined to each other.

Figure 2:
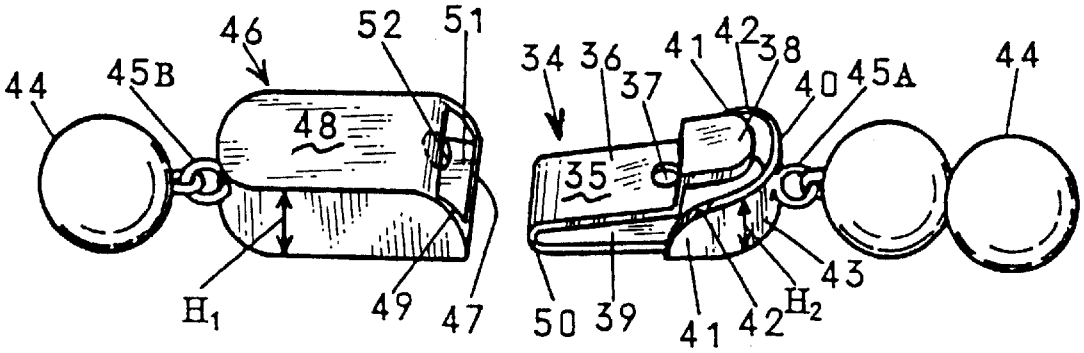
FIG. 2 is a perspective view showing a connecting device for jewelry and accessory according to a second embodiment of this invention, where a spring member is removed from a connecting device body.

In FIG. 2, numeral 34 denotes a spring member made in manner that a metallic plate having an elasticity is bent to make a given angle to form a plate spring 35 comprising a first plate spring section 36 and a second plate spring section 39. The first plate spring section 36 has a locking hole 37 at the center of its end portion and is, at its end portion, provided with a pushing handle 38 wholly rising stepwise and having an arc-like tip portion. The second plate spring section 39 is, at its one end portion, provided with a spring body side wall section 43 rising to arcuately surround the pushing handle 38 and including both side surface portions 41, 41 connecting with a central portion 40 of the rising section. The both side surface portions 41, 41 respectively have curved edges 42, 42 curved to lower to define arc or tapered configurations. The spring body side wall 43 is equipped with a connecting portion 45A being one ring for connection to one end of jewelry and accessory such as a single necklace.

Numeral 46 designates a connecting device body in which a spring casing section 48 having a hollow portion which can accept the spring member 34 is provided on the rear surface of a base plate 47 in which one side rectangular end portion is formed to have an arc configuration, with the spring casing section 48 having same configuration as that of the base plate 47. One side wall 49 of the spring casing section 48 is curved to form an arc or tapered configuration or curved to substantially fall at right angles. This curved side wall 49 has an entry 51 into which the spring member 34 is inserted from its turning portion 50. In this entry 51, an engaging opening 52 being a dowel is made to engage with the locking hole 37 of the spring member 34 due to the elasticity of the spring member 34 when the spring member 34 is inserted into the spring casing section 48. Further, the arc-like side wall of the spring casing section 48 is equipped with a connecting portion 45B being one ring for connection to the other end portion of the aforesaid single necklace 44.

In this embodiment, when the spring member 34 is inserted into the entry 51 from its turning portion 50 and then advanced into the spring casing section 48, the plate spring 36 is pressed by the end of the engaging portion 52, and when the locking hole 37 of the spring member 34 comes to a position opposed to the engaging portion 52, the plate spring 36 is released from the pressing by the end of the engaging portion 52 so that the locking hole 37 engages with the engaging portion 52 due to the elasticity of the plate spring 36 to inhibit the spring member 34 from coming out of the spring casing section 48.

In this state, in the case of disconnecting the spring member 34 from the connecting device body 46, the operation mentioned above is done. Since the height $H_1$ of the connecting device body 46 is designed to be equal or substantially equal to the height $H_2$ of the spring body side wall section 43 of the spring member 34, in the state that the spring member 34 is set in the spring casing section 48, the connecting device body 46, the pushing handle 38 of the spring member 34 and the spring body side wall section 43 make an appearance that a rectangular box is divided into two sections which in turn, are joined to each other.

It is also possible that a locking portion being a dowel is provided in the plate spring 35 in place of the locking hole 37 and an engaging hole is made in the connecting device body 46 in place of the engaging portion 52. In this case, in inserting the spring member 34 into the spring casing section 48, the pushing handle 38 is pressed and the spring member 34 is inserted thereinto while the first plate spring section 36 is brought close to the second plate spring section 39, and when the locking portion comes to a position opposed to the engaging portion, the pushing handle 38 is released from the pressing to make the locking portion engage with the engaging portion due to the elasticity of the plate spring 36.

Figure 3:
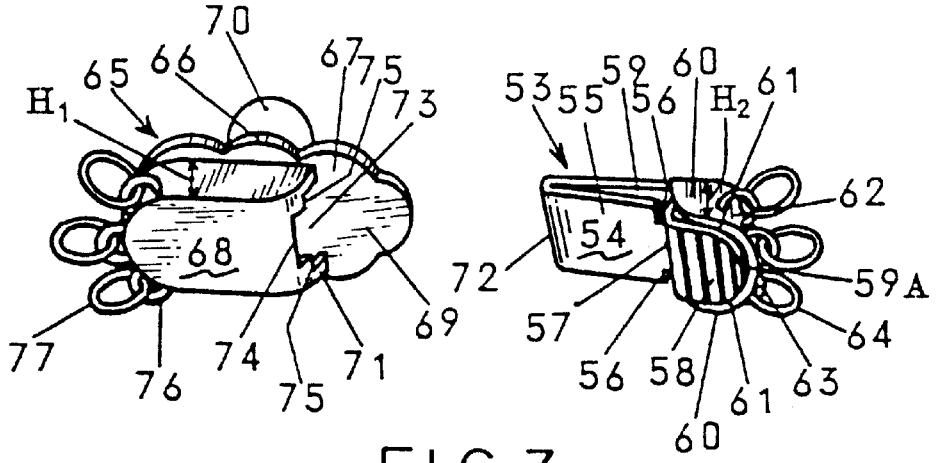
FIG. 3 is a perspective view showing a connecting device for jewelry and accessory according to a third embodiment of this invention, where a spring member is removed from a connecting device body.

In FIG. 3, numeral 53 depicts a spring member made in a manner that a metallic plate with an elasticity is bent to make a given angle to form a plate spring 54 comprising a first plate spring section 55 and a second plate spring section 59. The first plate spring section 55 is, at its one end portion, equipped with locking portions 56, 56 made in both side portions thereof and a pushing handle 58 rising stepwise from the tip portion of a connecting plate 57 narrowed by the locking portions 56, 56 and having an arc-like configuration. The second plate spring section 59 is, at its one end portion, provided with a spring body side wall section 62 rising to arcuately surround the pushing handle 58 and including both side surface portions 60, 60 connecting with a central portion 59A of the rising section. The both side surface portions 60, 60 respectively have curved edges 61, 61 curved to lower to define arc or tapered configurations. The spring body side wall 62 is equipped with a connecting portion 63 comprising three rings for connection to the respective one ends of a triple necklace 62A, and connecting rings are joined to this connecting portion 63.

Furthermore, numeral 65 signifies a connecting device body in which a spring casing section 68 having a hollow portion accepting the spring member 53 and having one arcuately formed rectangular side portion and a slide surface 69 for allowing the slide of the spring member 53 are placed on the rear surface of an elongated base plate 67 having a wave-like configuration 66 at its circumferential edge, while appropriate decorations (not shown in FIG. 3) are located on the front surface of the base plate 67 and a pearl is fixed on a central portion of the decorations. A side wall 71 of the spring casing section 68 on the slide surface 69 side is curved to make an arc or tapered configuration or to fall at right angles, and this curved side wall 71 has an entry 73 into which the spring member 53 is inserted from its turning portion 72. In this entry 73, an engaging opening 74 is made to engage with the connecting plate 57 of the spring member 53 due to the elasticity of the plate spring 55 when the spring member 53 is inserted in the spring casing section 68 and further engaging portions 75, 75 are made to engage with the locking portions 56, 56 of the spring member 53 at both sides of the engaging opening 74 due to the elasticity of the plate spring 55. An arc-like side wall of the spring casing section 68 opposite to the side wall 71 is equipped with a connecting portion 76 comprising three rings for connection with the other ends of the aforesaid triple necklace 62A. The rings of the connecting portion 76 are joined to connecting rings 77, respectively.

Figure 4:
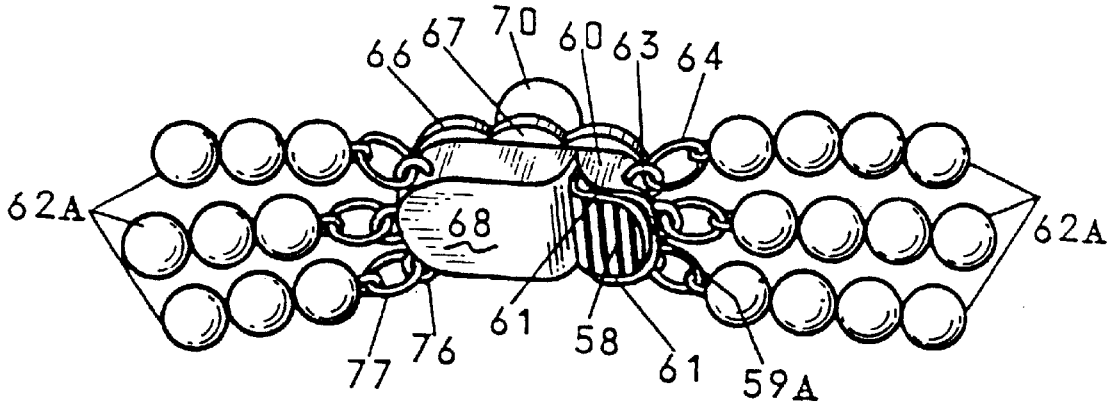
FIG. 4 is a perspective view showing a connecting device for jewelry and accessory according to the third embodiment, where a triple necklace is used as jewelry and accessory and the spring member is set in the connecting device body.
Figure 5:
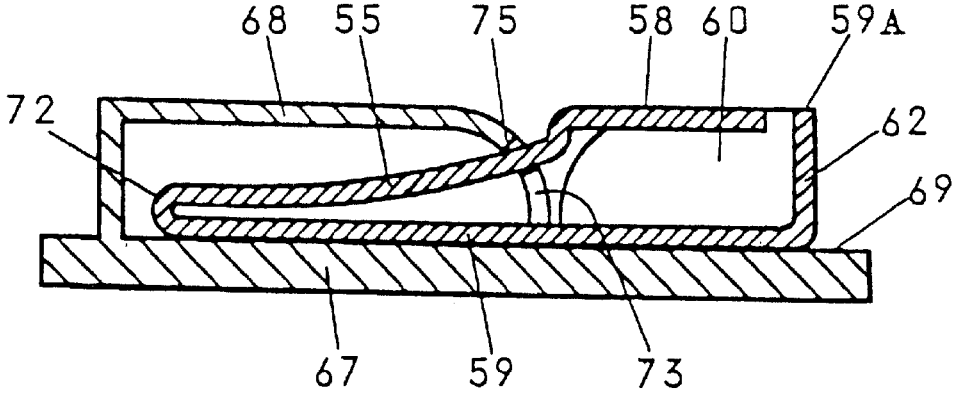
FIG. 5 is an enlarged cross-sectional view showing a connecting device for jewelry and accessory according to the third embodiment, where the spring member is locked with the connecting device body and the decorations are omitted from the illustration.

In this embodiment, as shown in FIG. 4, the one end portions of the triple necklace 62A are connected through the connecting rings 64 to the connecting portion 63, respectively, while the other end portions of the triple necklace 78 are connected through the connecting rings 77 to the connecting portion 76, respectively. Further, the spring member 53 slides in a state where the plate spring 59 is brought into contact with the slide surface 69, and the turning portion 72 of the spring member 53 is inserted into the entry 73 as shown in FIG. 5 and subsequently advanced into the spring the spring casing section 68. At this time, the plate spring 55 is pressed by the end portions of the engaging portions 75, 75, and when the locking portions 56, 56 of the spring member 53 pass through the engaging portions 75, 75, the plate spring 55 is released from the pressing by the engaging portions 75, 75, so that the connecting plate 57 engages with the engaging opening 74 due to the elasticity of the plate spring 55 and, at the same time, the locking portions 56, 56 also engage with the inner surfaces of the engaging portions 75, 75 due to the elasticity of the plate spring 55, with the result that the spring member 53 is locked with the spring casing section 68 so as not to come out.

In this state, in the case of disconnecting the spring member 53 from the connecting device body 65, the operation mentioned above is done. Since the height HI of the spring casing section 68 is designed to be equal or substantially equal to the height $H_2$ of the spring body side wall section 62 of the spring member 53, in the state that the spring member 53 is locked with the connecting device body 65, the spring casing section 68, the pushing handle 58 of the spring member 53 and the spring body side wall section 62 form an appearance that a rectangular box is divided into two sections which in turn, are joined to each other.

Figure 6:
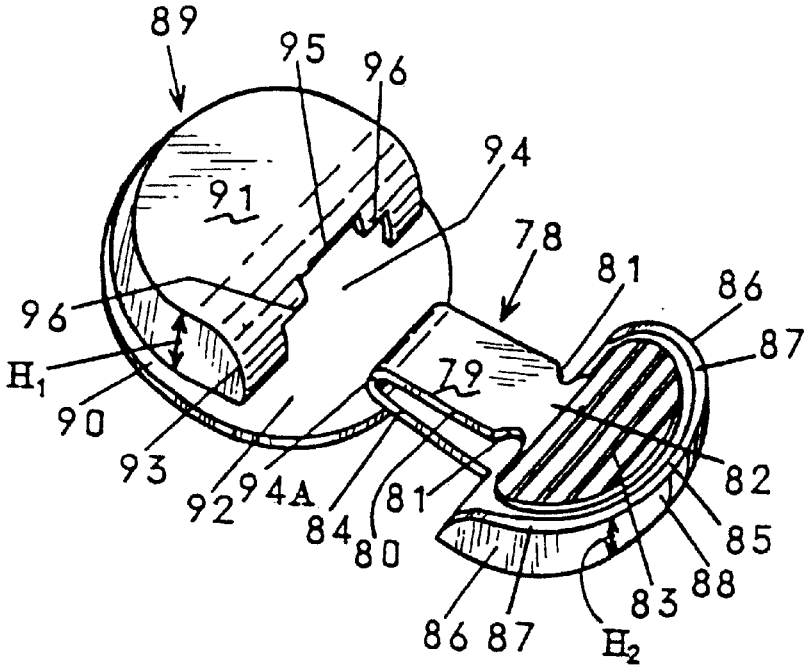
FIG. 6 is a perspective view showing a connecting device for jewelry and accessory according to a fourth embodiment of this invention, where a spring member is disconnected from a connecting device body.

In FIG. 6, numeral 78 indicates a spring member made in a manner that a metallic plate with an elasticity is bent to make a given angle to form a plate spring 79 comprising a first plate spring section 80 and a second plate spring section 84. The first plate spring section 80 is, at its one end portion, equipped with locking portions 81, 81 made in both side portions thereof and a pushing handle 83, rising stepwise from the tip portion of a connecting plate 82 narrowed by the locking portions 81, 81 and made to define one circular side portion. The second plate spring section 84 is, at its one end portion, provided with a spring body side wall section 88 rising to arcuately surround the pushing handle 83 and including both side surface portions 86, 86 connecting with a central portion 85 of the rising section. The both side surface portions 86, 86 respectively have curved edges 87, 87 curved to lower to define arc or tapered configurations. The spring body side wall 88 is equipped with a connecting portion (not shown in FIG. 6) of one end portion of jewelry and accessory.

Furthermore, numeral 89 signifies a connecting device body in which a spring casing section 91 having a hollow portion accepting the spring member 78 and making the other circular side portion and a slide surface 92 for allowing the slide of the spring member 78 are placed on the rear surface of a circular base plate 67 having a larger diameter than that of the spring body side wall 88. A side wall 93 of the spring casing section 91 on the slide surface 92 side is curved to make an arc or tapered configuration or to fall at right angles, and this curved side wall 93 has an entry 94 into which the spring member 78 is inserted from its turning portion 94A. In this entry 94, an engaging opening 95 is made to engage with the connecting plate 82 of the spring member 78 due to the elasticity of the plate spring 80 when the spring member 78 is inserted in the spring casing section 91 and further engaging portions 96, 96 are made to engage with the locking portions 81, 81 of the spring member 78 at both sides of the engaging opening 95 due to the elasticity of the plate spring 80. An arc-like side wall of the spring casing section 91 opposite to the side wall 93 is equipped with a connecting portion (not shown in FIG. 6) of the other end portion of the aforesaid jewelry and accessory.

Figure 7:
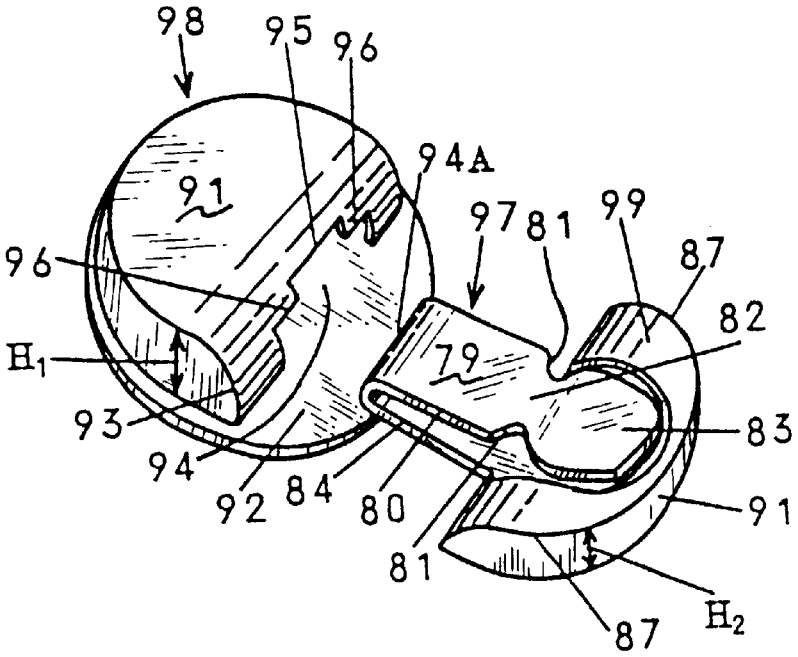
FIG. 7 is a perspective view showing a connecting device for jewelry and accessory according to a fifth embodiment of this invention, where a spring member is disconnected from a connecting device body.

In this embodiment, since the depression surface of the pushing handle 83 is larger than that of a pushing handle 83 shown in FIG. 7, it has the advantage of easy pressing. The operation for setting the spring member 78 in the connecting device body 89 and the operation for disconnecting the spring member 78 from the connecting device body 89 are the same as those mentioned before. Since the height $H_1$ of the spring casing section 91 is designed to be equal or substantially equal to the height $H_2$ of the spring body side wall section 88 of the spring member 78, in the state that the spring member 78 is locked with the connecting device body 89, the spring casing section 91, the pushing handle 83 of the spring member 78 and the spring body side wall section 88 form an appearance that a rectangular box is divided into two sections which in turn, are joined to each other.

In FIG. 7, numeral 97 represents a spring member and numeral 98 designates a connecting device body, with these having the same arrangements as those of the spring member 78 and the connecting device body 89 shown in FIG. 6, respectively. The difference of this embodiment is that a pushing handle 83 of the spring member 97 is made to be smaller in diameter than a spring casing section 91, and the diameter of a spring body side wall section 88 is made to be equal to that of the spring casing section 91, and further a cover wall 99 is provided which is curved to be brought close to a circumferential edge of the pushing handle 83 from curved edges 87, 87 of the spring body side wall section 88.

In this embodiment, the operation for setting the spring member 97 in the connecting device body 98 and the operation for disconnecting the spring member 97 from the connecting device body 98 are the same as those mentioned before. In the state that the spring member 97 is locked with the spring casing section 91, the spring casing section 91, the pushing handle 83 of the spring member 97, the cover wall 99 and the spring body side wall section 88 make an appearance that a rectangular box is divided into two sections which in turn, are joined to each other.

Figure 8:
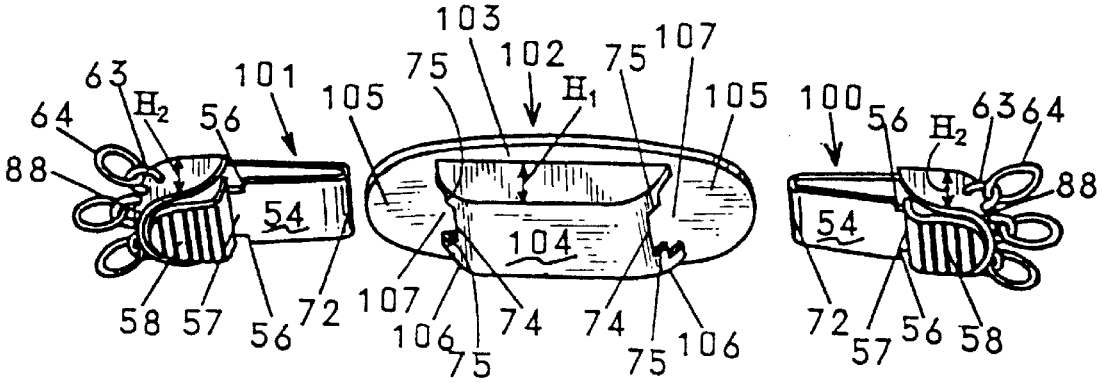
FIG. 8 is a perspective view showing a connecting device for jewelry and accessory according to a sixth embodiment of this invention, where a spring member is disconnected from a connecting device body.

In FIG. 8, numerals 100, 101 represent a pair of spring members, for example, each being constructed as well as the spring member 53 shown in FIG. 3. Numeral 102 denotes a connecting device body in which located on the rear surface of an oblong base plate 103 are a spring casing section 104 having a hollow portion for allowing the insertion of the pair of spring members 100, 101 in an opposed condition and slide surfaces 105, 105 for allowing the slide of the pair of spring members 100, 101. The spring casing section 104 is positioned at the central portion of the base plate 103 and the slide surfaces 105, 105 are placed both sides of the spring casing section 104, respectively. Both side walls 106, 106 of the spring casing section 104 on the slide surface 105, 105 sides are curved to form arc or tapered configurations or to fall at right angles. The curved side walls 106, 106 have entries 107, 107 into which the spring members 100, 101 are inserted from their turning portions 72, 72, respectively. In each of the entries 107, 107, an engaging opening 74 is made to engage with a connecting plate 57 of the spring member 100 or 101 due to the elasticity of a plate spring 55 when the spring member 100 or 101 is inserted into the spring casing section 103 and further engaging portions 75, 75 are provided to engage with locking portions 56, 56 of the spring member 100 or 101 at both sides of the engaging opening 74 due to the elasticity of the plate spring 55. Incidentally, in this embodiment, the slide surfaces 105, 105 are omissible.

In this embodiment, connecting portions of the one spring member 100 are connected through connecting rings 64 to the one ends of a triple necklace (not shown in FIG. 8), respectively, while connecting portions 63 of the other spring member 101 are connected through connecting rings 64 to the other ends of the triple necklace. Further, the operation for setting the spring members 100, 101 in the connecting device body 102 and the operation for disconnecting the spring members 100, 101 from the connecting device body 102 are the same as those mentioned before. Since the height $H_1$ of the spring casing section 104 is designed to be equal or substantially equal to the height $H_2$ of the spring body side wall section 88 of the spring member 88 of each of the spring members 100, 101, in the state that the spring members 100, 101 are locked with the connecting device body 102, the spring casing section 104, the pushing handles 83, 83 of the spring members 100, 101 and the spring body side wall sections 88, 88 constitute an appearance that an oblong box is divided into three sections which in turn, are joined to each other.

Figure 9:
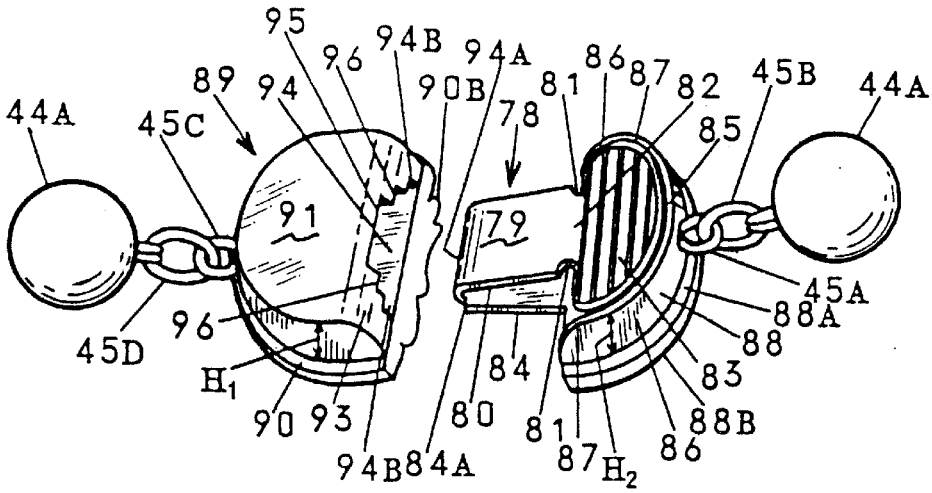
FIG. 9 is a perspective view showing a connecting device for jewelry and accessory according to a seventh embodiment of this invention, where a spring member is disconnected from a connecting device body.
Figure 10:
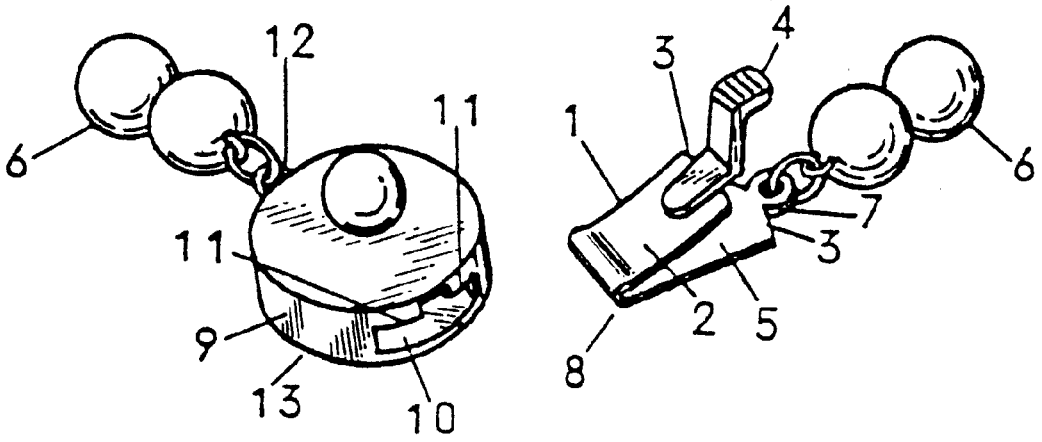
FIG. 10 is a perspective view showing a prior connecting device for jewelry and accessory, where a spring member is disconnected from a connecting device body.
Figure 11:
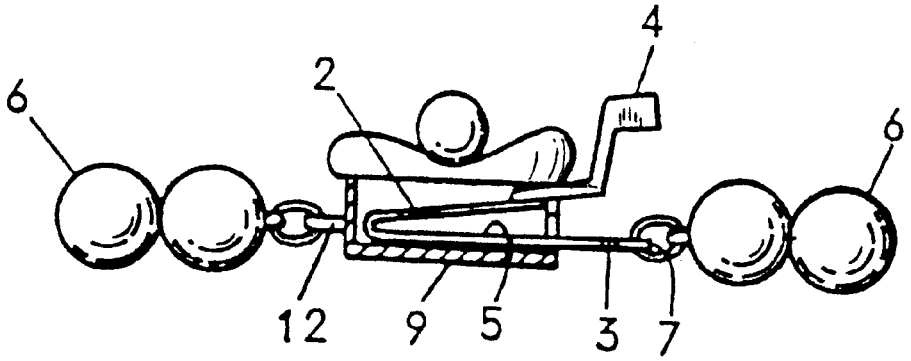
FIG. 11 is a perspective view showing a prior connecting device for jewelry and accessory, where the spring member is set in the connecting device body.

Although in the respective above-described embodiments in the end portion of the second plate spring section of the spring member nothing is placed on the surface opposite to the surface supporting the spring body side wall section, it is also possible to place a base plate corresponding to the base plate of the connecting device body on this opposite surface. This embodiment will be described hereinbelow with reference to FIG. 9. In FIG. 9, numeral 78 depicts a spring member made in a manner that a metallic plate having an elasticity is bent to make a given angle to produce a plate spring 79 comprising a first plate spring section 80 and a second plate spring section 84. The first plate spring section 80 is, at its one end portion, equipped with locking portions 81, 81 made in both side portions thereof and a pushing handle 83 rising stepwise from the tip portion of a connecting plate 82 narrowed by the locking portions 81, 81 and made to define one circular side portion. The second plate spring section 84 is made to have a larger width than that of the first plate spring section 80, and a spring body side wall section 88 rising to arcuately surround the pushing handle 83 and including both side surface portions 86, 86 connecting with a central portion 85 of the rising section is provided on the surface opposite to the pushing handle 83. The both side surface portions 86, 86 respectively have curved edges 87, 87 curved to lower to define arc or tapered configurations. In the end portion of the second plate spring section 84, a base plate 88A having a diameter larger than that of the spring body side wall section 88 is placed on the surface opposite to the surface on which the spring body side wall section 88 is provided. The spring body side wall 88 is equipped with a connecting portion 45A constructed with one ring which is connected to a connecting ring 45B attached to one end portion of a necklace 44A.

Furthermore, numeral 89 signifies a connecting device body in which a spring casing section 91 having a hollow portion accepting the spring member 78 and making the other circular side portion and having a diameter equal to that of the spring body side wall section 88 are placed on the rear surface of a base plate 67 constituting the other circular side portion and having a diameter equal to that of a base plate 88A. A side wall 93 of the spring casing section 91 on the opposite side of a circular side wall is curved to make an arc or tapered configuration or to fall at right angles, and this curved side wall 93 has entries 94B, 94B into which both side protruding edges 84A of the second plate spring section 84 of the spring member 78 are inserted and further has an entry 94 into which the spring member 78 is inserted from its turning portion 94A. In this entry 94, an engaging opening 95 is made to engage with the connecting plate 82 of the spring member 78 due to the elasticity of the plate spring 80 when the spring member 78 is inserted in the spring casing section 91 and further engaging portions 96, 96 are made to engage with the locking portions 81, 81 of the spring member 78 at both sides of the engaging opening 95 due to the elasticity of the plate spring 80. An arc-like side wall of the spring casing section 91 opposite to the side wall 93 is equipped with a connecting portion 45C comprising one ring which in turn, is connected to a connecting ring 45D attached to the other end of the necklace 44A. The entries 94B, 94B serve to prevent the vertical looseness in a state where the spring member 78 is inserted into the spring casing section 91.

In this embodiment, decorations 88B, 90B are attached onto the surfaces of the base plate 88A and the base plate 90, respectively, or the decorations are not attached thereto so that the flat configurations are left, and at the time that the spring member 78 is inserted into the spring casing section 91, the base plate 88A and the base plate 90 are joined to each other to integrally constitute decorations. The operation for setting the spring member 78 in the connecting device body 89 and the operation for disconnecting the spring member 78 from the connecting device body 89 are the same as those mentioned before. Since the height $H_1$ of the spring casing section 91 is designed to be equal or substantially equal to the height $H_2$ of the spring body side wall section 88 of the spring member 78, in the state that the spring member 78 is locked with the connecting device body 89, the spring casing section 91, the pushing handle 83 of the spring member 78 and the spring body side wall section 88 constitute an appearance that a circular box is divided into two sections which in turn, are joined to each other.

The present invention is not limited to the above-described embodiments, but the locking portions, the pushing handle and the spring body side wall section placed on the spring member and the spring casing section and the entries located on the connecting device body can assume arrangements other than those of the above-described embodiments.

For instance, both the side surface portions of the spring body side wall section of the spring member are not limited to the arc and tapered configurations, but it is also appropriate that they are curved to lower to form a right-angle or wave-like configurations. Further, appropriate decorative holes can also be made in the side wall portions of the spring casing section of the connecting device body and the spring body side wall section of the spring member, respectively, and the connecting rings of a necklace are connected to these decorative holes to achieve the direct connection to the necklace. Moreover, the portions other than the side wall portions of the spring casing section can also have decorative holes. In addition, projections can also be formed inside the hollow portion of the spring casing section to suppress the vertical looseness after the setting of the spring member. Further, in the case of using jewelry and accessory such as straps, the spring member and the connecting device body can also be equipped with connecting portions which permit the direct connection to the one end and the other end of the jewelry and accessory. On the other hand, in the case of using other jewelry and accessory, one or a plurality of connecting portions can also be provided. The connecting portions are not limited to the rings, but different adequate shapes and structures can also be employed in accordance with the jewelry and accessory. The spring casing section provided on the rear surface of the base plate of the connecting device and the depression and spring body side wall section of the spring member to be inserted into the spring casing section can also constitute configurations or shapes other than those of the above-described embodiments. The proximal portion of a wire safety can also be connected to one of the spring member and the connecting device body while a dowel for hooking the wire safety can also be attached to the other.

According to this invention, since arranged as described above, it is possible to prevent the spring member from being inserted into the spring casing section in a state of being upside down, and hence, when setting the spring member in the connecting device body, there is no need to pay attention to the direction of the spring member and the normal setting is always possible, which allows the easy-to-use and prevents the falling accidents of the jewelry and accessory. In addition, since the pushing handle of the spring member is surrounded by the spring body side wall section, unlike the prior jewelry and accessory connecting device the pushing handle does not protrude, which can prevent the skin of the user of the jewelry and accessory connecting device from being injured and prevent the hair from being hooked and further provide an excellent decorative appearance. Moreover, in the case of using a flat plate as the base plate, in use the surface of the flat plate can be brought into contact with the skin, and further, the surface of the spring casing section placed on the rear surface of the flat plate can be brought into contact with the skin. That is, it is possible to use both front and rear surfaces of the jewelry and accessory connecting device.

It should be understood that the foregoing relates to only preferred embodiments of the present invention, and that it is intended to cover all changes and modifications of the embodiments of the invention herein used for the purpose of the disclosure, which do not constitute departures from the spirit and scope of the invention.

What is claimed is:

1. A connecting device for jewelry and accessory comprising:

a spring member made in manner that a metallic plate with an elasticity is bent to form a plate spring comprising a first plate spring section and a second plate spring section which made a given angle therebetween, said first plate spring section having one end equipped with a locking portion and a pushing handle, while said second plate spring section having one end equipped with a spring body side wall section rising to surround said pushing handle, said spring body side wall section having curved edges curved to lower so that both side surface portions thereof continuing with its central portion have one of an arc configuration and a tapered configuration, and further said spring body side wall section being provided with a connecting portion of one end portion of said jewelry and accessory; and a connecting device body including a base plate and a spring casing section placed on a rear surface of said base plate, said spring casing section having a hollow portion to accept said spring member and having one side wall curved to lower to form one of an arc configuration and a tapered configuration, the curved side wall having an entry to insert said spring member, and in said entry, an engaging portion is provided to engage with said locking portion of said spring member due to the elasticity of said plate spring when said spring member is inserted into said spring casing section, and further the other side wall of said spring casing section is equipped with a connecting portion of the other end portion of said jewelry and accessory.

2. A connecting device for jewelry and accessory as defined in claim 1, further comprising a second base plate placed on a surface of said second plate spring section of said spring member, said surface being opposite to the surface on which said spring body side wall section is located, said second base plate integrally constituting decorations in cooperation with said first-mentioned base plate of said connecting device body when said spring member is inserted into said spring casing section.

3. A connecting device for jewelry and accessory comprising:

a spring member made in manner that a metallic plate with an elasticity is bent to form a plate spring comprising a first plate spring section and a second plate spring section which made a given angle therebetween, said first plate spring section having one end equipped with a locking portion and a pushing handle, while said second plate spring section having one end equipped with a spring body side wall section rising to surround said pushing handle, said spring body side wall section having curved edges curved to lower so that both side surface portions thereof portion have its central portion have one of an arc configuration and a tapered configuration, and further said spring body side wall section being provided with a connecting portion of one end portion of said jewelry and accessory; and a connecting device body including a base plate and a spring casing section placed on a rear surface of said base plate, said spring casing section having a hollow portion to accept said spring member and having one side wall curved to lower at right angles, the curved side wall having an entry to insert said spring member, and in said entry, an engaging portion is provided to engage with said locking portion of said spring member due to the elasticity of said plate spring when said spring member is inserted into said spring casing section, and further the other side wall of said spring casing section is equipped with a connecting portion of the other end portion of said jewelry and accessory.

4. A connecting device for jewelry and accessory as defined in claim 3, further comprising a second base plate placed on a surface of said second plate spring section of said spring member, said surface being opposite to the surface on which said spring body side wall section is located, said second base plate integrally constituting decorations in cooperation with said first-mentioned base plate of said connecting device body when said spring member is inserted into said spring casing section.

5. A connecting device for jewelry and accessory comprising:

a pair of spring members each made in manner that a metallic plate with an elasticity is bent to form a plate spring comprising a first plate spring section and a second plate spring section which made a given angle therebetween, said first plate spring section having one end equipped with a locking portion and a pushing handle, while said second plate spring section having one end equipped with a spring body side wall section rising to surround said pushing handle, said spring body side wall section having curved edges curved to lower so that both side surface portions thereof continuing with its central portion have one of an arc configuration and a tapered configuration; and a connecting device body including a base plate and a spring casing section placed on a rear surface of said base plate, said spring casing section having a hollow portion to accept said pair of spring members in an opposed relation and having both side walls each curved to lower to form one of an arc configuration and a tapered configuration, each of the curved side walls having an entry to insert said spring member, and in said entry, an engaging portion is provided to engage with said locking portion of said spring member due to the elasticity of said plate spring when said spring member is inserted into said spring casing section.

6. A connecting device for jewelry and accessory as defined in claim 5, wherein each of said spring members further includes a second base plate placed on a surface of said second plate spring section, said surface being opposite to the surface on which said spring body side wall section is located, said second base plate integrally constituting decorations in cooperation with said first-mentioned base plate of said connecting device body when said spring member is inserted into said spring casing section.

7. A connecting device for jewelry and accessory comprising:

a pair of spring members each made in manner that a metallic plate with an elasticity is bent to form a plate spring comprising a first plate spring section and a second plate spring section which made a given angle therebetween, said first plate spring section having one end equipped with a locking portion and a pushing handle, while said second plate spring section having one end equipped with a spring body side wall section rising to surround said pushing handle, said spring body side wall section having curved edges curved to lower so that both side surface portions thereof continuing with its central portion have one of an arc configuration and a tapered configuration; and a connecting device body including a base plate and a spring casing section placed on a rear surface of said base plate, said spring casing section having a hollow portion to accept said pair of spring members in an opposed relation and having both side walls each curved to lower at right angles, each of the curved side walls having an entry to insert said spring member, and in said entry, an engaging portion is provided to engage with said locking portion of said spring member due to the elasticity of said plate spring when said spring member is inserted into said spring casing section.

8. A connecting device for jewelry and accessory as defined in claim 7, wherein each of said spring members further includes a second base plate placed on a surface of said second plate spring section, said surface being opposite to the surface on which said spring body side wall section is located, said second base plate integrally constituting decorations in cooperation with said first mentioned base plate of said connecting device body when said spring member is inserted into said spring casing section.

* * * * *